US012011637B2

(12) United States Patent
Corbalis et al.

(10) Patent No.: US 12,011,637 B2
(45) **Date of Patent: *Jun. 18, 2024**

(54) APPARATUS, SYSTEM, AND METHOD FOR A FLEXIBLE TREADMILL DECK

(71) Applicant: Core Health & Fitness, LLC, Vancouver, WA (US)

(72) Inventors: Kevin Corbalis, Tustin, CA (US); Steve Neill, Orange, CA (US); Dustan Baker, Ladera Ranch, CA (US); Victor Cornejo, Riverside, CA (US); Ken Duong, Stanton, CA (US); Alex Wargnier, Costa Mesa, CA (US)

(73) Assignee: Core Health & Fitness, LLC, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/963,158

(22) Filed: Oct. 10, 2022

(65) Prior Publication Data

US 2023/0033923 A1 Feb. 2, 2023

Related U.S. Application Data

(63) Continuation of application No. 16/011,563, filed on Jun. 18, 2018, now Pat. No. 11,465,012.
(Continued)

(51) Int. Cl.
*A63B 22/02* (2006.01)

(52) U.S. Cl.
CPC ..... *A63B 22/0214* (2015.10); *A63B 22/0221* (2015.10); *A63B 22/0285* (2013.01)

(58) Field of Classification Search
CPC ..... A63B 22/0214; A63B 22/0221; A63B 22/0285; A63B 2024/0009; A63B 2024/0012; A63B 2024/0015; A63B 2024/0018; A63B 2024/0025; A63B 2024/0068; A63B 2024/0065; A63B 2024/007; A63B 2024/0078; A63B 2024/0084; A63B 2024/0087;
(Continued)

(56) References Cited

U.S. PATENT DOCUMENTS 5,382,207 A * 1/1995 Skowronski ..... A63B 22/025 482/904
5,669,857 A * 9/1997 Watterson ..... A63B 22/0023 482/54

(Continued)

FOREIGN PATENT DOCUMENTS

GB _2294206_A_1 * 10/1993 ..... A63B 22/02
GB 2294206 A * 4/1996 ..... A63B 22/02
KR 20090114709 A * 11/2009 ..... A63B 22/0285

OTHER PUBLICATIONS

KR-20090114709-A_Translation (Year: 2023).*

*Primary Examiner* — Megan Anderson
(74) *Attorney, Agent, or Firm* — FOLEY & LARDNER LLP

(57) ABSTRACT

A treadmill including a frame, a suspension connector, a flexible deck, and a belt. The suspension connector is connected to the frame. The flexible deck is connected to the suspension connector. The flexible deck includes a metal panel extending substantially an entire width and length of the flexible deck. The belt is disposed on the flexible deck.

20 Claims, 13 Drawing Sheets

Related U.S. Application Data

(60) Provisional application No. 62/521,136, filed on Jun. 16, 2017.

(58) Field of Classification Search

CPC ..... A63B 2024/009; A63B 2024/0093; A63B 2024/0096; A63B 24/00; A63B 24/0006; A63B 24/0021; A63B 24/0062; A63B 24/0075; A63B 24/0084; A63B 24/0087; A63B 23/00; A63B 23/02; A63B 23/0222; A63B 23/0227; A63B 23/035; A63B 23/03508; A63B 23/03525; A63B 23/03533; A63B 23/03541; A63B 23/0355; A63B 23/03558; A63B 23/03575; A63B 23/03583; A63B 23/03591; A63B 23/04; A63B 23/0464; A63B 23/0458; A63B 23/047; A63B 23/0476; A63B 23/10; A63B 2022/0028; A63B 2022/003; A63B 2022/0033; A63B 2022/0038; A63B 2022/0041; A63B 2022/0051; A63B 2022/0053; A63B 2022/0271; A63B 2022/0278; A63B 2022/0647; A63B 2022/0635; A63B 22/00; A63B 22/02; A63B 22/0207; A63B 22/0228; A63B 22/0235; A63B 22/0242; A63B 22/025; A63B 22/0257; A63B 22/06; A63B 22/0605; A63B 22/0005; A63B 22/0007; A63B 22/001; A63B 22/0076; A63B 22/0012; A63B 22/0015; A63B 22/0017; A63B 22/0023; A63B 22/0025; A63B 22/0046; A63B 22/0048; A63B 22/0056; A63B 22/0058; A63B 22/14; A63B 22/16

USPC ..... 482/54

See application file for complete search history.

(56) References Cited

U.S. PATENT DOCUMENTS 5,827,155 A 10/1998 Jensen et al.
5,897,461 A * 4/1999 Socwell ..... A63B 22/02 482/54
6,013,011 A * 1/2000 Moore ..... A63B 22/02 482/77
6,174,267 B1 1/2001 Dalebout
6,179,753 B1 1/2001 Barker et al.
6,273,829 B1 * 8/2001 Carlson ..... C22C 32/00 473/316
6,416,443 B1 * 7/2002 Choy ..... A63B 22/0214 482/54
6,461,275 B1 10/2002 Wang et al.
7,140,485 B1 * 11/2006 Chang ..... A63B 22/02 482/54
7,357,758 B2 4/2008 Polk et al.
11,465,012 B2 * 10/2022 Corbalis ..... A63B 22/0221
2001/0024998 A1 * 9/2001 Novak ..... A63B 22/02 482/54
2001/0049323 A1 * 12/2001 Fox ..... A63B 22/0023 482/54
2002/0045518 A1 * 4/2002 Dalebout ..... A63B 22/02 482/51
2002/0052267 A1 * 5/2002 Wang ..... A63B 22/0235 482/54
2002/0094916 A1 7/2002 Wang et al.
2002/0103057 A1 * 8/2002 Watterson ..... A63B 22/0023 482/54
2003/0040405 A1 2/2003 Watterson et al.
2003/0045403 A1 * 3/2003 Watterson ..... A63B 22/0207 482/51
2003/0060331 A1 * 3/2003 Polk, III ..... A63B 22/0023 482/20
2003/0060334 A1 * 3/2003 Lo ..... A63B 22/0023 482/51
2003/0153434 A1 * 8/2003 Dalebout ..... A63B 22/02 482/54
2003/0195088 A1 * 10/2003 Wang ..... A63B 22/0023 482/54
2003/0199332 A1 * 10/2003 Lindsay ..... A63B 60/00 473/305
2004/0214693 A1 * 10/2004 Piaget ..... A63B 21/154 482/52
2004/0220020 A1 * 11/2004 Wang ..... A63B 22/0235 482/54
2004/0242378 A1 * 12/2004 Pan ..... A63B 22/0207 482/54
2005/0148443 A1 * 7/2005 Watterson ..... A63B 22/0023 482/54
2005/0164839 A1 * 7/2005 Watterson ..... A63B 22/02 482/54
2005/0209060 A1 * 9/2005 Lull ..... A63B 22/0235 482/52
2006/0003869 A1 * 1/2006 Huang ..... A63B 22/02 482/54
2007/0123396 A1 * 5/2007 Ellis ..... A63B 21/0618 482/54
2008/0070756 A1 3/2008 Chu
2008/0171640 A1 * 7/2008 Chang ..... A63B 22/0228 482/54
2008/0287267 A1 * 11/2008 Ellis ..... A63B 21/4035 482/54
2008/0312047 A1 12/2008 Feng
2009/0088301 A1 * 4/2009 Alling ..... A63B 22/0235 482/54
2009/0181829 A1 * 7/2009 Wu ..... A63B 22/02 482/54
2010/0035731 A1 * 2/2010 Rohr ..... B32B 5/024 482/54
2011/0082011 A1 * 4/2011 Ellis ..... A63B 21/4047 482/54
2011/0281691 A1 * 11/2011 Ellis ..... A63B 23/047 482/54
2013/0267387 A1 * 10/2013 Watterson ..... A63B 22/02 482/54
2015/0250304 A1 * 9/2015 Dalebout ..... A63B 22/02 482/54
2016/0023045 A1 * 1/2016 Dalebout ..... A63B 24/0087 482/8
2016/0023049 A1 * 1/2016 Dalebout ..... A63B 22/0242 482/7
2016/0107020 A1 4/2016 Donato et al.
2016/0287930 A1 * 10/2016 Moser ..... A63B 24/0087
2017/0136289 A1 * 5/2017 Frank ..... A63B 22/025
2017/0189745 A1 7/2017 Hamilton et al.
2017/0266483 A1 9/2017 Dalebout et al.
2017/0333747 A1 11/2017 Athey
2017/0333748 A1 11/2017 Becker et al.
2018/0043207 A1 2/2018 Moser
2018/0126249 A1 5/2018 Consiglio et al.
2018/0140896 A1 5/2018 Chen
2018/0185699 A1 * 7/2018 Kueker ..... A63B 22/0264
2019/0151706 A1 5/2019 Jiang

* cited by examiner

APPARATUS, SYSTEM, AND METHOD FOR A FLEXIBLE TREADMILL DECK

CROSS-REFERENCE TO RELATED APPLICATIONS

This application is a continuation of U.S. patent application Ser. No. 16/011,563, filed Jun. 18, 2018, which claims priority to U.S. Provisional Patent Application No. 62/521,136, entitled "Apparatus, System, and Method for a Flexible Treadmill Deck," filed on Jun. 16, 2017. Each of which is hereby incorporated by reference in its entirety.

SUMMARY

Embodiments of a treadmill are described. The treadmill includes a frame, a suspension connector connected to the frame, and a flexible deck connected to the suspension connector. The flexible deck is configured to flex in response to a load applied by a user striding on the treadmill. The suspension connector includes a suspension pivot that allows rotation of the flexible deck around the suspension pivot. Other embodiments of the treadmill are also described.

BRIEF DESCRIPTION OF THE DRAWINGS

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

While many embodiments are described herein, at least some of the described embodiments provide a system for a treadmill with a flexible deck.

Figure 1:
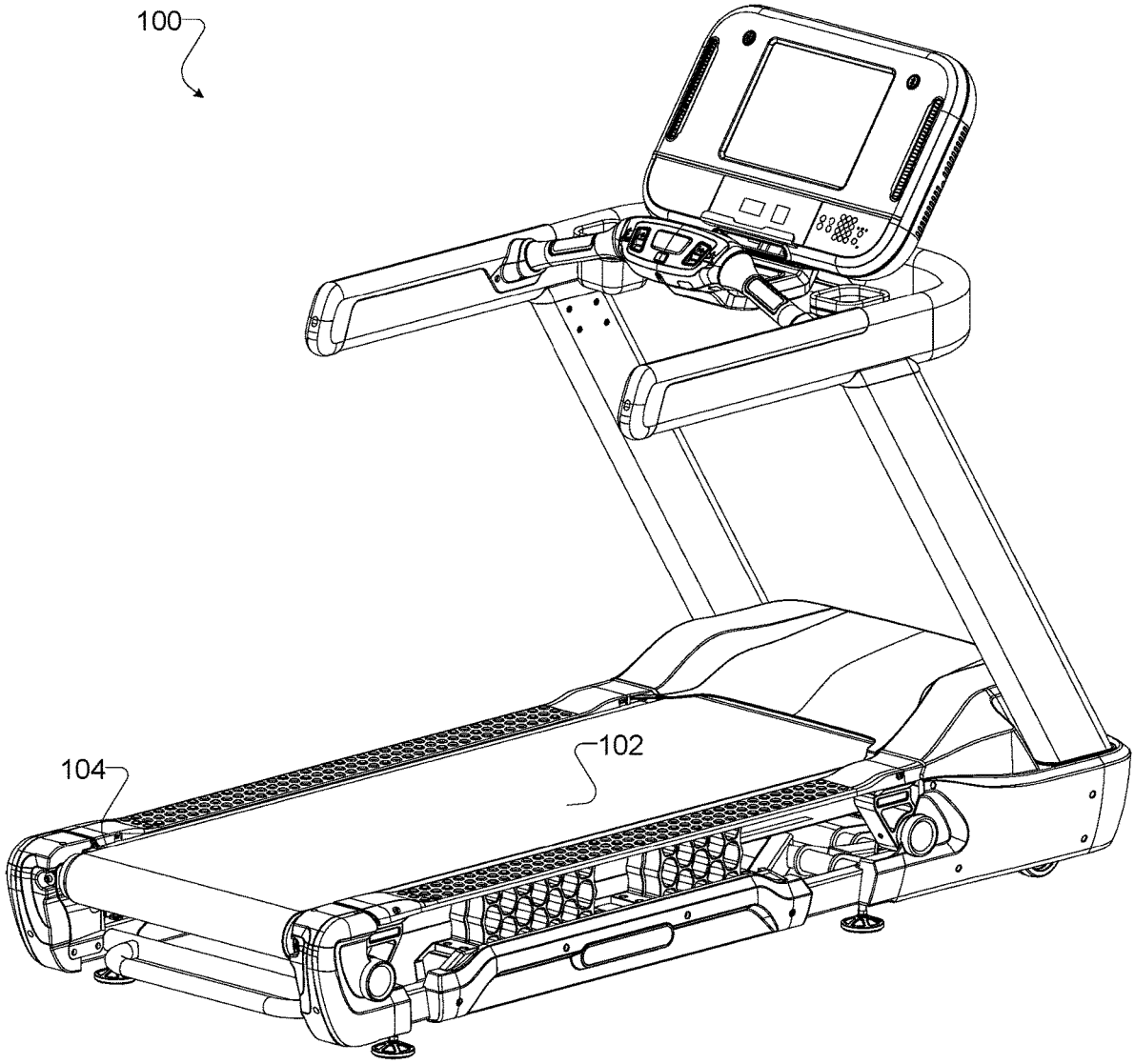
FIG. 1 depicts a perspective view of one embodiment of a treadmill with a flexible deck.

FIG. 1 depicts a perspective view of one embodiment of a treadmill 100 with a flexible deck 104. The treadmill 100 includes a belt 102 and a flexible deck 104. The treadmill 100 causes the belt 102 to move continuously to provide a walking surface for a user. In an alternate embodiment, the belt 102 moves in response to forces supplied by a user walking on the treadmill 100.

The belt 102, in certain embodiments, is a continuous belt. The belt 102 may travel over one or more elements of the treadmill 100, such as rollers (not shown). The belt 102 may include any material known in the art, including, but not limited to, synthetic rubber.

In some embodiments, the flexible deck 104 is disposed within the belt 102 and provides a support surface to a user striding on the treadmill 100. The flexible deck 104 may include one or more components configured to provide or manage flex in the flexible deck 104. The flexible deck 104 is described in greater detail in relation to FIGS. 2-7 below.

Figure 2:
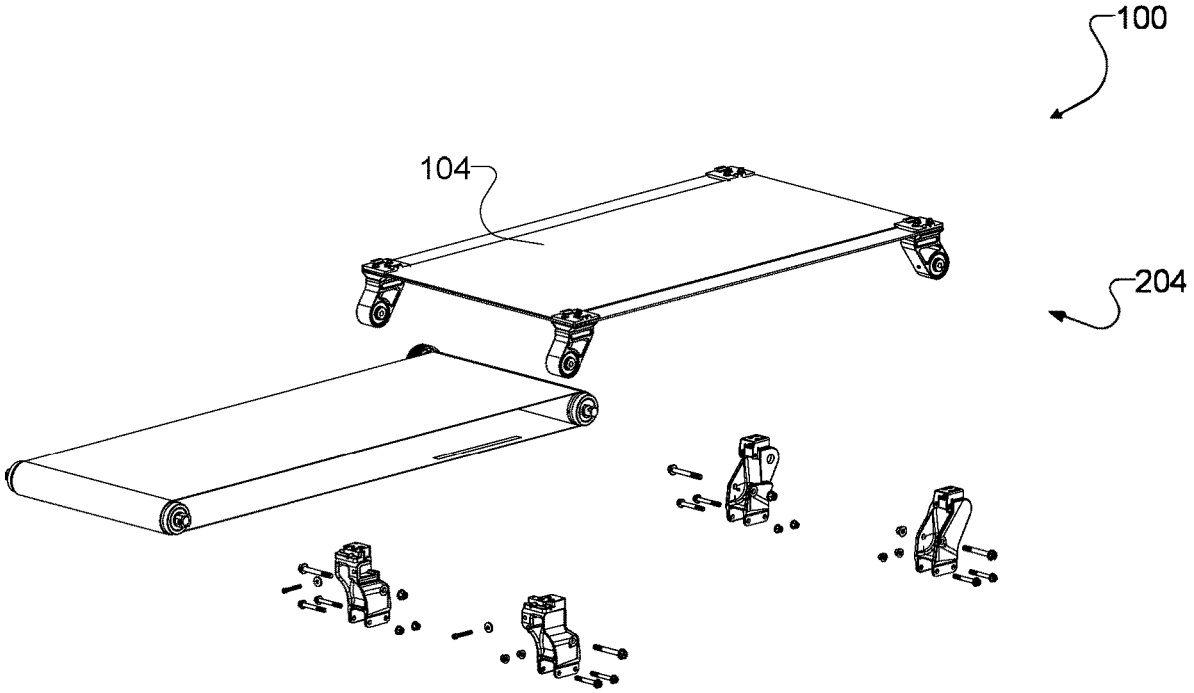
FIG. 2 depicts an exploded perspective view of one embodiment of the treadmill of FIG. 1.
Figure 2:
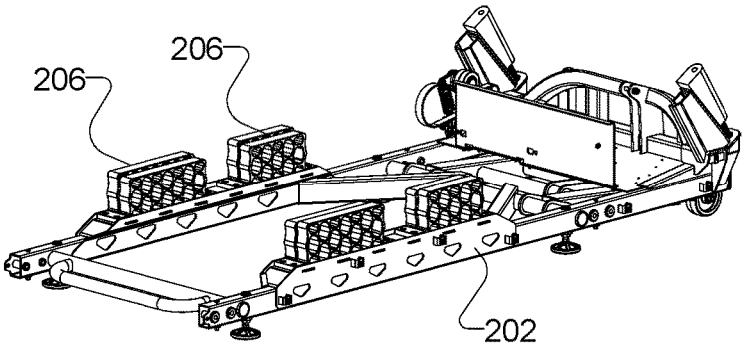

FIG. 2 depicts an exploded perspective view of one embodiment of the treadmill 100 of FIG. 1. The treadmill 100 includes the flexible deck 104, a frame 202, one or more suspension connectors 204, and one or more intermediate supports 206. The treadmill 100 provides managed response of the flexible deck 104 for users of the treadmill 100.

The frame 202, in some embodiments, provides support and attachment points for other components of the treadmill 100. The frame 202 may include any material capable of providing the stiffness and strength necessary for the other components of the treadmill 100 to perform the requisite functions. In one embodiment, the frame 202 includes a metal, such as steel.

The suspension connector 204, in one embodiment, is disposed between the flexible deck 104 and the frame 202. The suspension connector 204 provides a connection between the flexible deck 104 and the frame 202 that facilitates flex of the flexible deck 104. The suspension connector 204 may provide rotation of at least a portion of the flexible deck 104 relative to the frame 202 around one or more axes. In some embodiments, the suspension connector 204 allows for translation of at least a portion of the flexible deck 104 relative to the frame 202 in one or more directions.

In one embodiment, the treadmill 100 includes four suspension connectors 204. The suspension connectors 204 may be disposed at or near four corners of the flexible deck 104. Embodiments of the suspension connector 204 are described in greater detail below.

The one or more intermediate supports 206, in some embodiments, are each disposed between the frame 202 and the flexible deck 104. In some embodiments, the treadmill 100 includes an intermediate support 206 on each of two opposing sides of the frame 202. In one embodiment, the treadmill 100 includes more than one intermediate support 206 on each of two opposing sides of the frame 202.

Each intermediate support 206 manages movement of a portion of the flexible deck 104. In one embodiment, the intermediate support 206 progressively resists flexion of the flexible deck 104 in response to an applied force on the flexible deck 104, such as the weight of a user standing or striding on the flexible deck 104. In certain embodiments, the intermediate support 206 dampens movement of the flexible deck 104.

The intermediate support 206 may include any material capable of performing the functions of the intermediate support 206. For example, the intermediate support 206 may include a polymer material. In one example, the intermediate support 206 includes polyurethane.

In certain embodiments, the response of the intermediate support 206 is adjustable. For example, the intermediate support 206 may be adjustable to increase or decrease a spring constant of the intermediate support 206. In other words, a stiffness of the intermediate support 206 may be adjusted. In another embodiment, a position of the intermediate support 206 may be adjustable relative to the flexible deck 104. In some embodiments, the intermediate support 206 may be adjustable such that it moves closer to or further away from the flexible deck 104. In one embodiment, the intermediate support 206 may be adjustable such that it moves closer to or further away from a suspension connector 204. In some embodiments, the intermediate support 206 dampens movement of the flexible deck 104.

For example, it may be useful to tune the intermediate support 206 to correspond to a weight of a user. The intermediate support 206 may be stiffened for a user with a relatively high weight, and the stiffness of the intermediate support 206 may be reduced for a user with a relatively low weight.

In some embodiments, adjustment of the stiffness of the intermediate support 206 may be manual. A user may add or remove components of the treadmill 100, may adjust the position of one or more components, or take other actions to modify the stiffness of the intermediate support 206. An example of a manually adjustable intermediate support 206 is described below in relation to FIG. 7.

In another embodiment, adjustment of the stiffness or location of the intermediate support 206 may be automated. For example, the treadmill 100 may adjust the interaction of the intermediate support 206 with the flexible deck 104 in response to determining a weight of a user. In one example, the treadmill 100 may adjust a position of the intermediate support 206 relative to other components of the treadmill 100. In another example, one or more components of the intermediate support 206 may be moved in response to determining a user's weight. In yet another example, the intermediate support 206 includes a fluid spring or fluid damper, such as a hydraulic shock or an air spring, and a fluid, such as air, water, or oil, may be pumped into or out of the intermediate support 206 in response to a determination of a user's weight. In a different embodiment, the response of the intermediate support 206 is selectively modified by an electromagnet (not shown), such as in a magnetorheological damper. In another embodiment, an electromagnetic actuator (not shown) adjusts a position of the intermediate support 206 relative to other components of the treadmill 100. The electromagnetic actuator may apply a force to the intermediate support 206 to adjust the position of the intermediate support 206.

Figure 3:
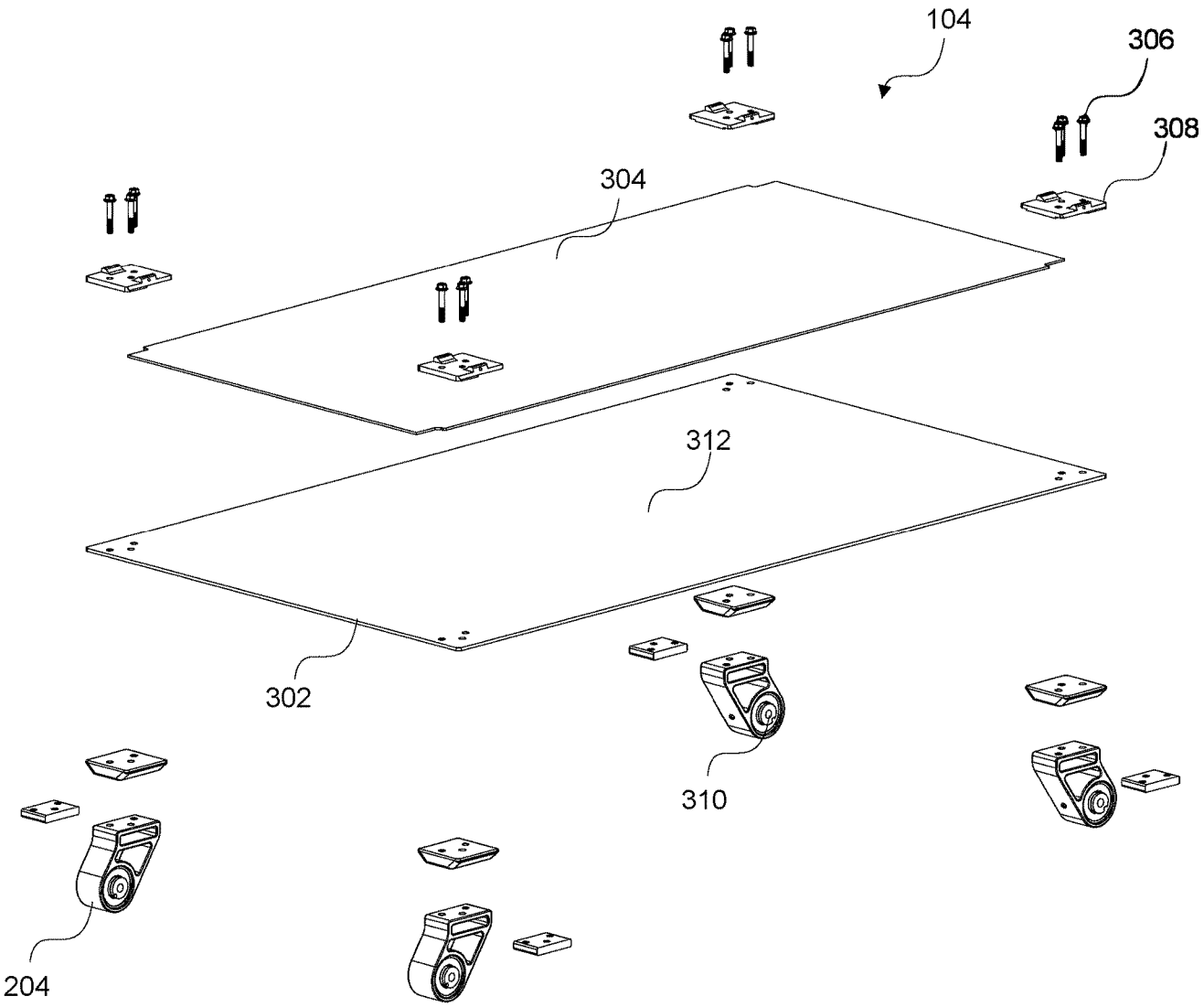
FIG. 3 depicts an exploded perspective view of one embodiment of the flexible deck of FIG. 1.

FIG. 3 depicts an exploded perspective view of one embodiment of the flexible deck 104 of Figure I. The flexible deck 104 includes a flexible component 302 and a wear surface 304. The flexible deck 104 flexes in response to a force applied by a user striding on the treadmill 100.

The flexible component 302 includes a flexible material that, when supported at opposite ends of the flexible component 302, flexes in response to a force provided by a user striding on the treadmill 100. The flexible component 302 may include any materials that provided a desired flexibility, strength, and weight for the flexible deck 104. For example, the flexible component 302 may include a sheet of aluminum. In an alternative example, the flexible component 302 may include a polymer. In another example, the flexible component 302 may include a composite material, such as carbon fiber or fiberglass in a polymer matrix.

In one embodiment, the flexible component 302 includes a metal panel. The metal panel may extend substantially the entire width and length of the flexible deck 104. In certain embodiments, the flexible deck 104 includes a heat transfer surface 312 to transfer heat from the belt 102 to the metal panel. The metal panel may conduct heat away from the belt 102 and radiate excess heat to the surrounding air. This may reduce the average temperature of the belt 102 relative to the temperature of a treadmill 100 without a metal panel and a heat transfer surface 312.

In some embodiments, the flexible deck 104 includes a wear surface 304. The wear surface 304 may resist wear of the flexible deck 104 as the treadmill 100 is operated. In some embodiments, the wear surface 304 is replaceable. In certain embodiments, the wear surface 304 exhibits a relatively low friction as the belt 102 travels over the wear surface 304. For example, the wear surface 304 may include a phenolic sheet.

In an alternate embodiment, the flexible component 302 includes a surface treatment that acts as the wear surface 304. For example, the flexible component 302 may be aluminum, and one or more surfaces of the aluminum may be anodized to form a wear surface 304.

In certain embodiments, the flexible deck 104 is connected to the suspension connector 204. The flexible deck 104 may be connected to the suspension connector 204 using one or more deck fasteners 306. In some embodiments, the one or more deck fasteners 306 may interact with one or more deck fastener plates 308 to secure the flexible component 302 to the suspension connector 204. In some embodiments, the one or more deck fasteners 306 may interact with one or more deck fastener plates 308 to secure the wear surface 304 to the suspension connector 204.

The suspension connector 204 may include a suspension pivot 310. The suspension pivot 310 may be connected to the frame 102. In one embodiment, a portion of the flexible deck 104 pivots around the suspension pivot 310 in response to an applied load on the flexible deck 104.

Figure 4:
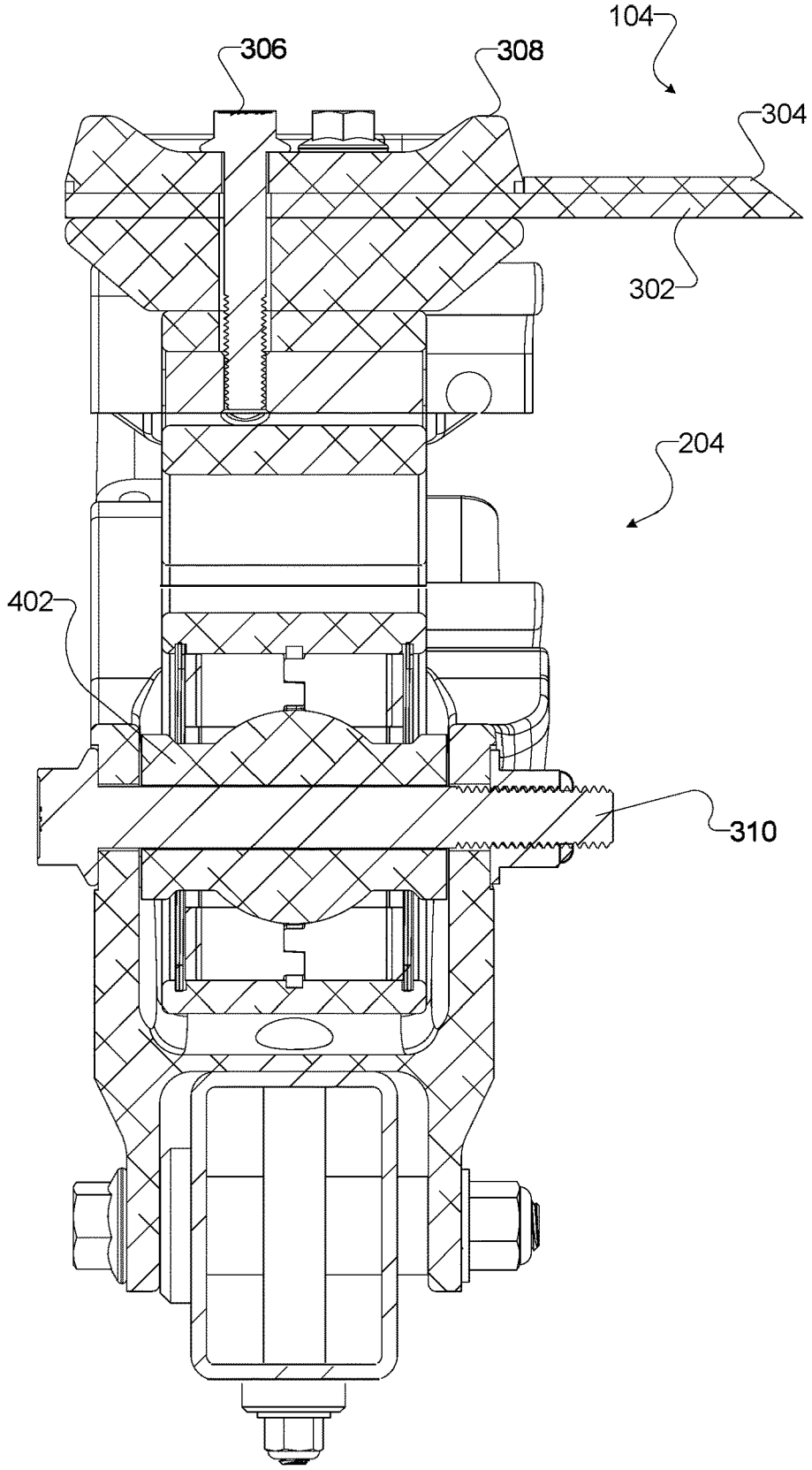
FIG. 4 depicts a front cross-sectional view of one embodiment of the flexible deck of FIG. 1.

FIG. 4 depicts a front cross-sectional view of one embodiment of the flexible deck 104 of FIG. 1. The flexible deck 104 includes a flexible component 302 and a wear surface 304. In some embodiments, the flexible deck 104 is connected to a suspension connector 204. The flexible component 302, the wear surface 304, and the suspension connector 204 may be similar to like-numbered components described above. The flexible deck 104 flexes in response to a force applied by a user striding on the treadmill 100.

In some embodiments, the flexible deck 104 is connected to the suspension connector 204 using a deck fastener 306. The deck fastener 306 may be configured to cooperate with a deck fastener plate 308 to secure one or more components of the flexible deck 104 to the suspension connector 204.

In one embodiment, the suspension connector 204 includes a suspension bushing 402. The suspension bushing 402 may be configured to deform under an applied force. In some embodiments, the suspension bushing 402 allows for one or more of rotation and translation of the flexible deck 104 relative to other components of the treadmill 100. In one embodiment, the suspension bushing 402 allows a portion of the flexible deck 104 near the deck fastener 306 to rotate around a suspension pivot 310 under a load applied by a user striding on the treadmill 100.

The suspension bushing 402 may include any material capable of performing the functions of the suspension bushing 402. For example, the suspension bushing 402 may include a polymer material. In one example, the suspension bushing 402 includes polyurethane.

Figure 5:
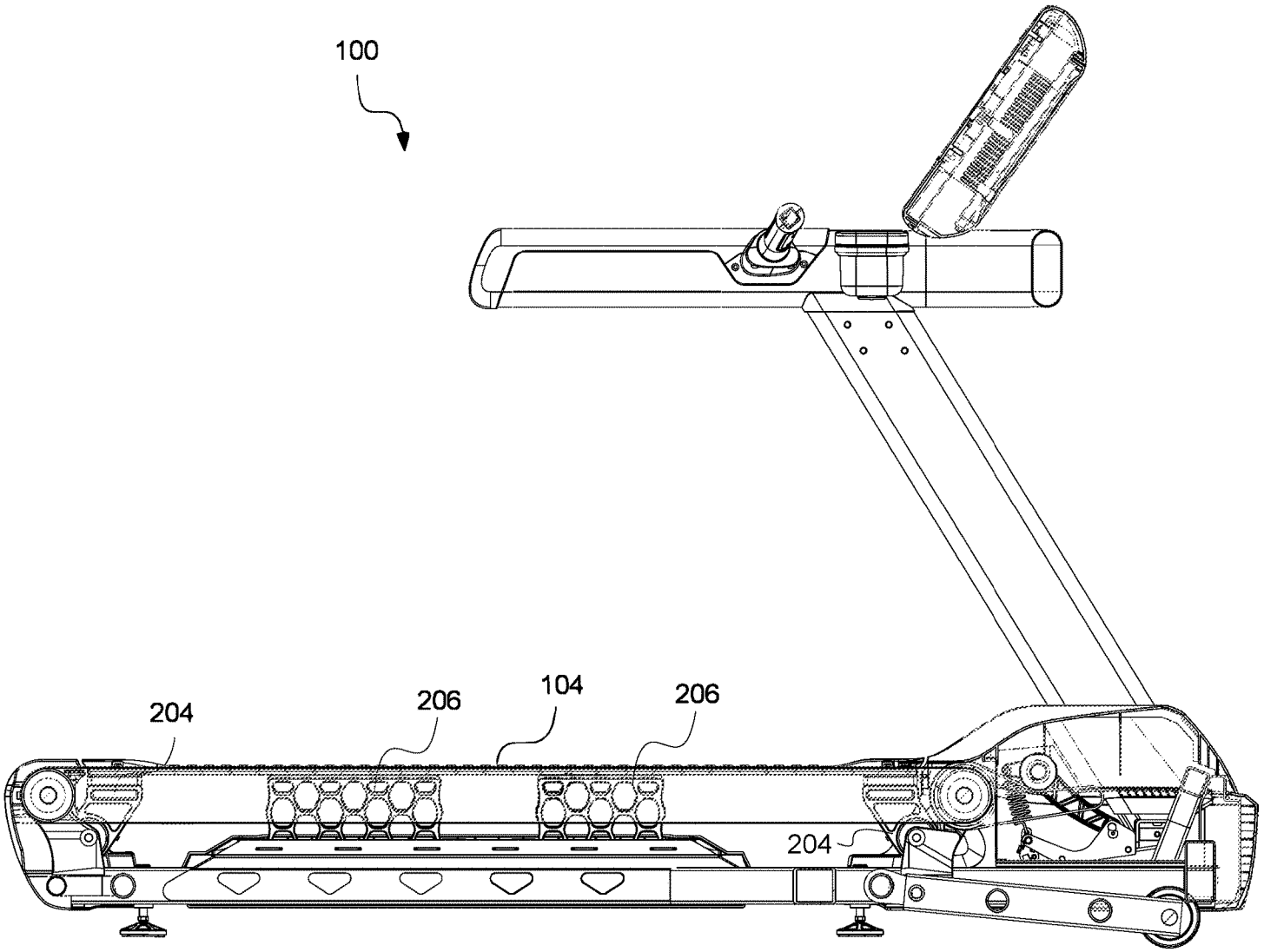
FIG. 5 depicts a side cross-sectional view of one embodiment of the treadmill of FIG. 1.

FIG. 5 depicts a side cross-sectional view of one embodiment of the treadmill 100 of FIG. 1. The treadmill 100 includes a flexible deck 104, one or more suspension connectors 204, and one or more intermediate supports 206. The flexible deck 104, the one or more suspension connectors 204, and the one or more intermediate supports 206 may be similar to like-numbered components described above. The treadmill 100 provides a striding surface with a managed flex response.

In one embodiment, the treadmill 100 includes four suspension connectors 204. The flexible deck 104 may be substantially rectangular and a suspension connector 204 may be disposed at or near each corner of the rectangular flexible deck 104. The suspension connectors 204 may connect the flexible deck 104 to other components of the treadmill 100. In some embodiments, the suspension connectors 204 deform under a force applied by a user striding on the treadmill 100 to manage a flex response of the flexible deck 104.

The treadmill 100, in some embodiments, includes two intermediate supports 206. The flexible deck 104 may be substantially rectangular and an intermediate support 206 may be disposed between two suspension connectors 204 at or near a left and right side of the rectangular flexible deck 104. The intermediate supports 206 may support the flexible deck 104 relative to other components of the treadmill 100. In some embodiments, the intermediate supports 206 deform under a force applied by a user striding on the treadmill 100 to manage a flex response of the flexible deck 104. In one embodiment, the stiffness of the intermediate supports 206 are adjustable.

Figure 6A:
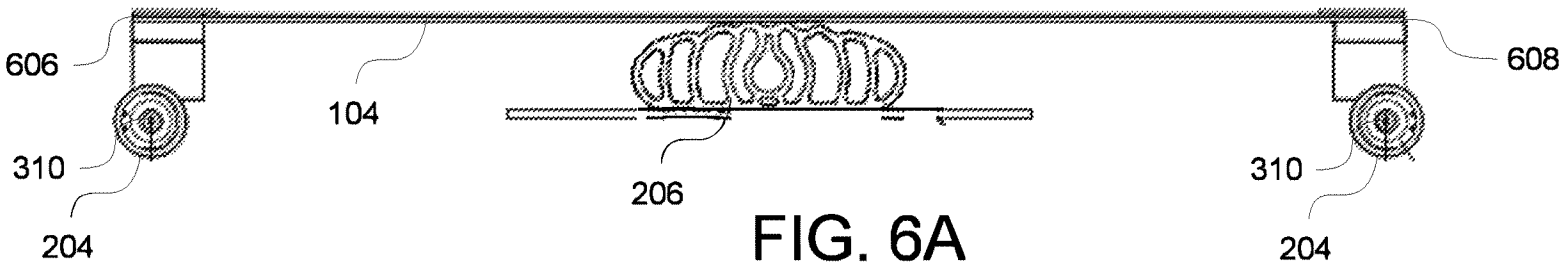
FIGS. 6A-6C depict side views of one embodiment of the flexible deck of FIG. 1 under no applied force, a moderate applied force, and a high applied force, respectively.
Figure 6B:
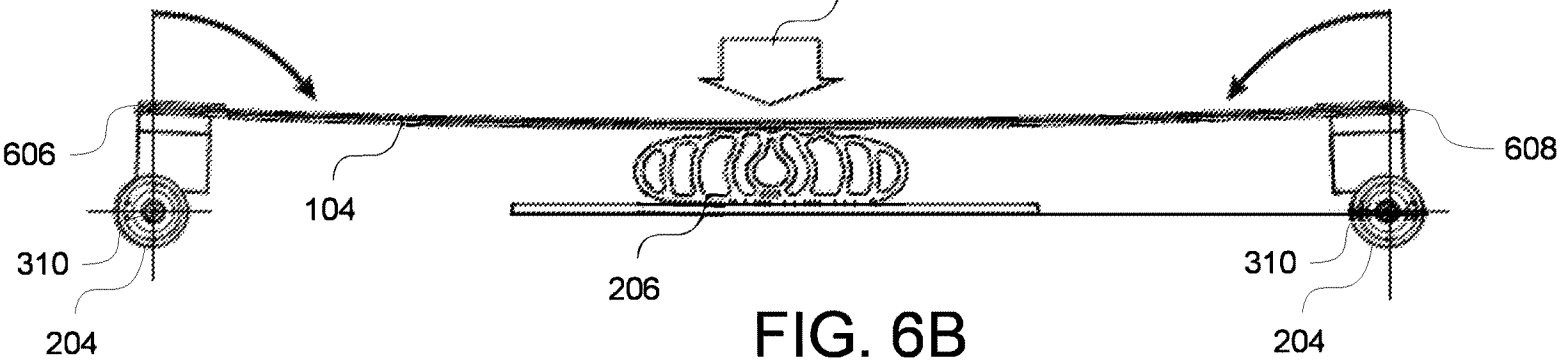
Figure 6C:
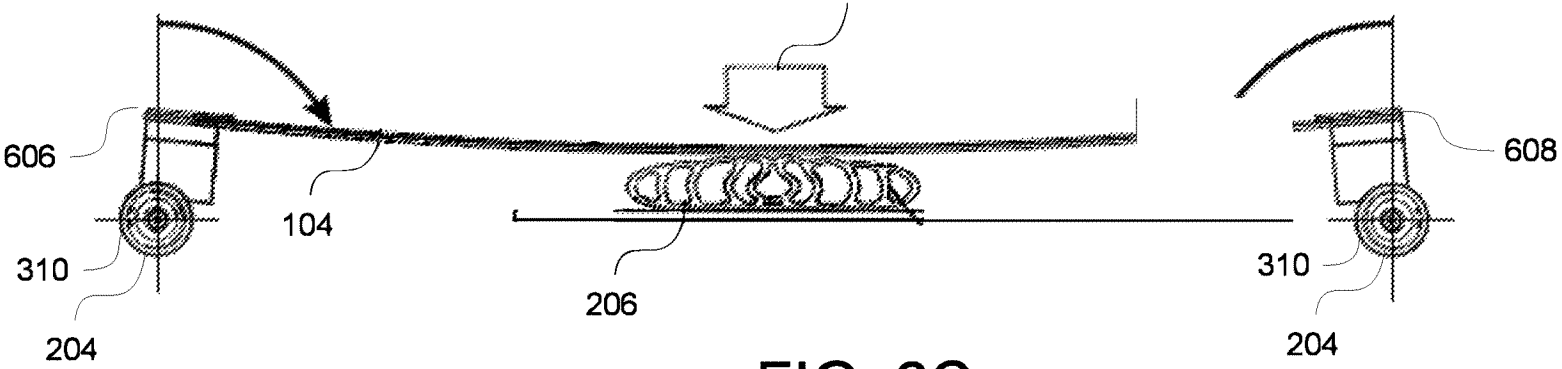

FIGS. 6A-6C depict side views of one embodiment of the flexible deck 104 of FIG. 1 under no applied force, a moderate applied force 602, and a high applied force 604, respectively. The flexible deck 104 is connected to the treadmill 100 via a plurality of suspension connectors 204. The flexible deck 104 is configured to flex under an applied force.

In one embodiment, the flexible deck 104 is substantially rectangular and a suspension connector 204 is disposed at each of a first end 606 and a second end 608 of the flexible deck 104. The suspension connectors 204 are configured to rotate around a suspension pivot 310 in response to an applied load. In FIG. 6B, a moderate applied load 602, such as that caused by a relatively low-weight user striding on the treadmill 100, causes moderate flexion of the flexible deck 104. At or near the first end 606, the flexible deck 104 pivots around the suspension pivot 310 in response to the moderate applied force 602. At or near the second end 608, the flexible deck 104 pivots in an opposite direction around a suspension pivot 310 in response to the moderate applied force 602. In response to a relatively high applied force 604, flexion and pivoting of the deck is relatively higher than that caused in response to the moderate applied force 602.

The intermediate support 206, in some embodiments, supports the flexible deck 104 and resists flexion of the flexible deck 104. In response to the moderate applied force 602, the intermediate support 206 deforms and applies a reaction force to counter the intermediate force 602. In response to a relatively high applied force 604, deformation of the intermediate support 206 and the resulting reaction force are relatively higher.

Figure 7:
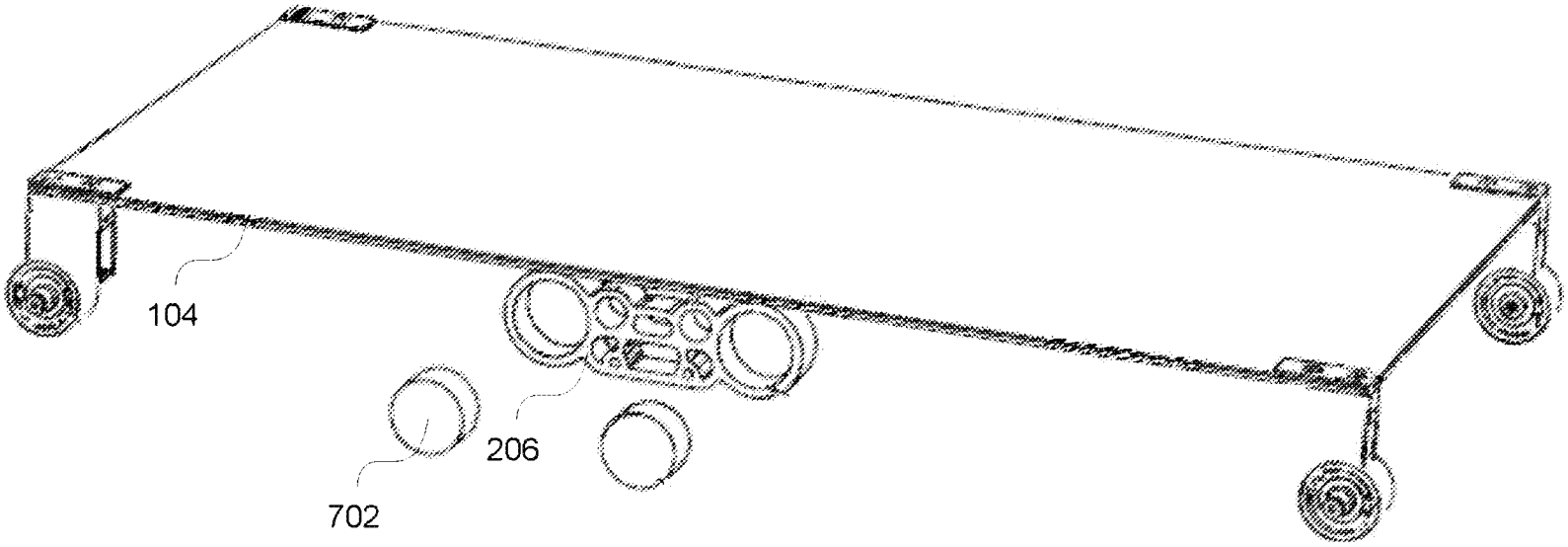
FIG. 7 depicts a perspective view of one embodiment of the flexible deck of FIG. 1 with a stiffener.

FIG. 7 depicts a perspective view of one embodiment of the flexible deck 104 of FIG. 1 with a stiffener 702. In one embodiment, the stiffener 702 is a component that can be added to the intermediate support 206. For example, the stiffener 702 may be polyurethane component than can be inserted into the intermediate support 206 to change the response of the intermediate support 206 to an applied force.

The stiffener 702 may be configured to be manually added to the treadmill 100 by a user. In another embodiment, the stiffener 702 may be automatically applied in response to a user input or a determination by the treadmill that a user exceeds a predetermined weight.

Figure 8:
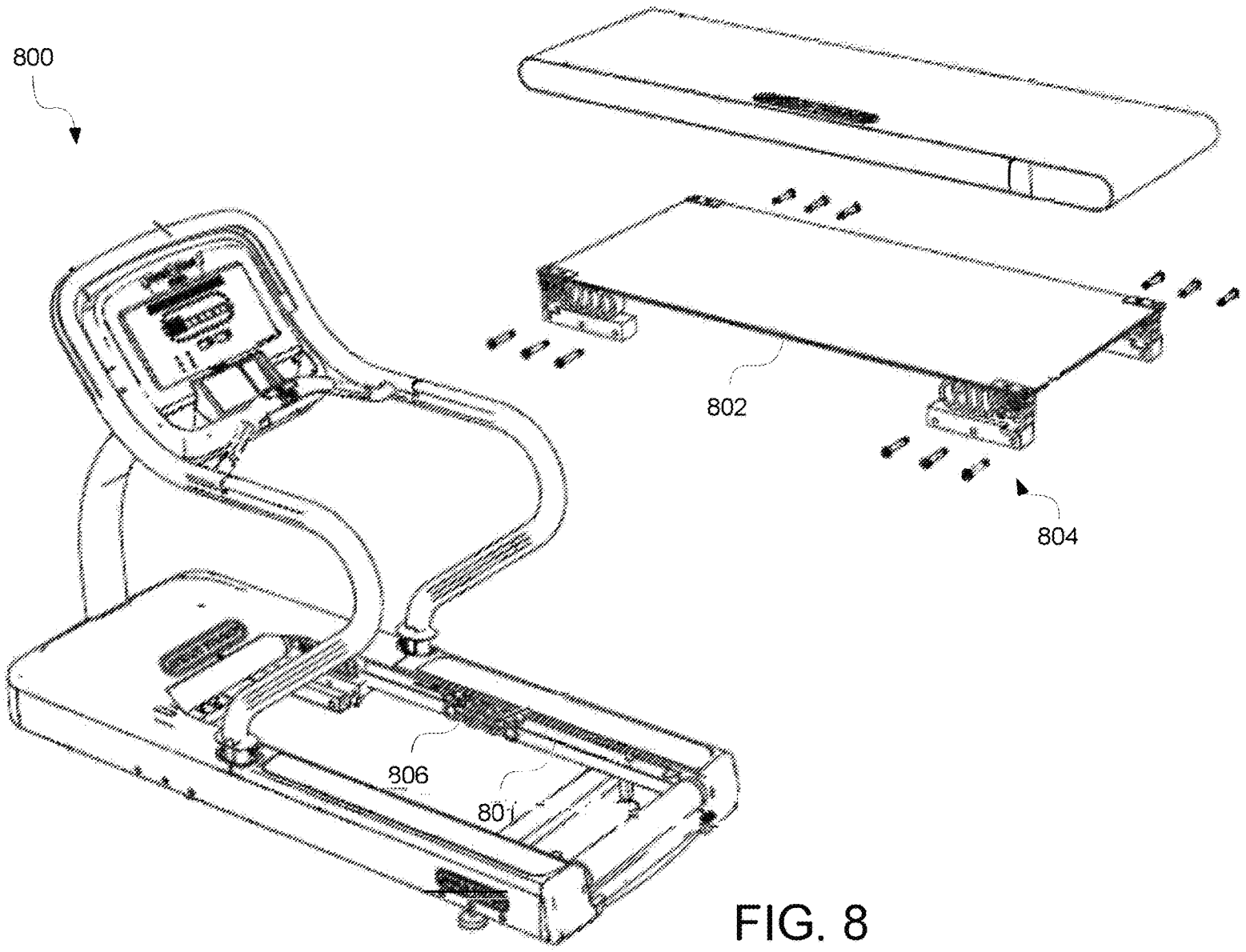
FIG. 8 depicts an exploded perspective view of one embodiment of a treadmill with a flexible deck.

FIG. 8 depicts an exploded perspective view of one embodiment of a treadmill 800 with a flexible deck 802. The treadmill 800 includes the flexible deck 802, a frame 801, one or more suspension connectors 804, and one or more intermediate supports 806. The treadmill 800 provides managed foot impact for users of the treadmill 800.

The frame 801, in some embodiments, provides support and attachment points for other components of the treadmill 800. The frame 801 may include any material capable of providing the stiffness and strength necessary for the other components of the treadmill 800 to perform the requisite functions. In one embodiment, the frame 801 includes steel.

The suspension connector 804, in one embodiment, is disposed between the flexible deck 802 and the frame 801. The suspension connector 804 provides a connection between the flexible deck 802 and the frame 801 that manages flex of the flexible deck 802. The suspension connector 804 may allow rotation of at least a portion of the flexible deck 802 relative to the frame 801 around one or more axes. In some embodiments, the suspension connector 804 allows for translation of at least a portion of the flexible deck 802 relative to the frame 801 in one or more directions.

In one embodiment, the treadmill 800 includes four suspension connectors 804. The suspension connectors 804 may be disposed at or near four corners of the flexible deck 802. Embodiments of the suspension connector 804 are described in greater detail below.

The intermediate support 806, in some embodiments, is disposed between the frame 801 and the flexible deck 802. The intermediate support 806 manages movement of a portion of the flexible deck 802. In one embodiment, the intermediate support 806 progressively resists flexion of the flexible deck 802 in response to an applied force on the flexible deck 802, such as the weight of a user standing or striding on the treadmill 800. In certain embodiments, the intermediate support 806 dampens movement of the flexible deck 802.

The intermediate support 806 may include any material capable of performing the functions of the intermediate support 806. For example, the intermediate support 806 may include a polymer material. In one example, the intermediate support 806 includes polyurethane.

In certain embodiments, the response of the intermediate support 806 is adjustable. For example, the intermediate support 806 may be adjustable to increase or decrease a spring constant of the intermediate support 806. In other words, a stiffness of the intermediate support 806 may be adjusted. In some embodiments, the response of the intermediate support 806 may be adjusted to change how the intermediate support 806 dampens movement of the flexible deck 802.

For example, it may be useful to tune the intermediate support 806 to correspond to a weight of a user. The intermediate support 806 may be stiffened for a user with a relatively high weight, and the stiffness of the intermediate support 806 may be reduced for a user with a relatively low weight.

In some embodiments, adjustment of the stiffness of the intermediate support 806 may be manual. A user may add or remove components of the treadmill 800, may adjust the position of one or more components, or take other actions to modify the stiffness of the intermediate support 806.

In another embodiment, adjustment of the stiffness of the intermediate support 806 may be automated. For example, the treadmill 800 may adjust the interaction of the intermediate support 806 with the flexible deck 802 in response to determining a weight of a user. In one example, the treadmill 800 may adjust a position of the intermediate support 806 relative to other components of the treadmill 800. In another example, one or more components of the intermediate support 806 may be moved in response to determining a user's weight. In yet another example, the intermediate support 806 includes a fluid spring or fluid damper, such as a hydraulic shock or an air spring, and a fluid, such as air, water, or oil, may be pumped into or out of the intermediate support 806 in response to a determination of a user's weight. In a different embodiment, the response of the intermediate support 806 is modified by an electromagnet (not shown), such as in a magnetorheological damper. In another embodiment, an electromagnetic actuator (not shown) adjusts a position of the intermediate support 806 relative to other components of the treadmill 800. The electromagnetic actuator may apply a force to the intermediate support 806 to adjust the position of the intermediate support 806.

Figure 9:
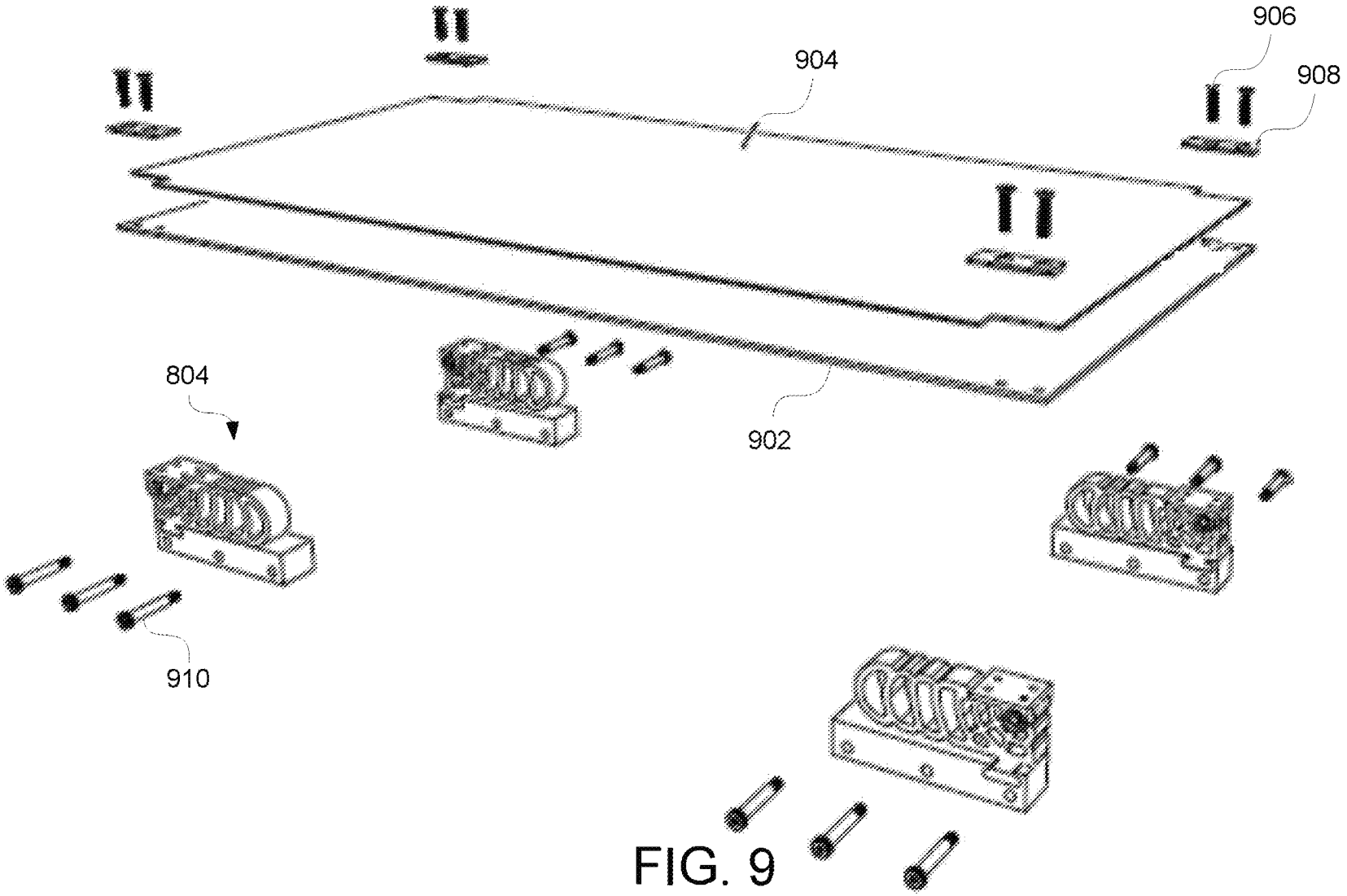
FIG. 9 depicts an exploded perspective view of one embodiment of the flexible deck of FIG. 8.

FIG. 9 depicts an exploded perspective view of one embodiment of the flexible deck 802 of FIG. 8. The flexible deck 802 includes a flexible component 902 and a wear surface 904. The flexible deck 802 flexes in response to a force applied by a user striding on the treadmill 800.

The flexible component 902 includes a flexible material that, when supported at it opposite ends of the flexible component 902, flexes in response to a force provided by a user striding on the treadmill 800. The flexible component 902 may include any materials that provided a desired flexibility, strength, and weight for the flexible deck 802. For example, the flexible component 902 may include a sheet of aluminum. In an alternative example, the flexible component 902 may include a polymer. In another example, the flexible component 902 may include a composite material, such as carbon fiber or fiberglass in a polymer matrix.

In some embodiments, the flexible deck 802 includes a wear surface 904. The wear surface 904 may resist wear of the flexible deck 802 as the treadmill 800 is operated. In some embodiments, the wear surface 904 is replaceable. In certain embodiments, the wear surface 904 exhibits a relatively low friction as the belt 102 travels over the wear surface 904.

In an alternate embodiment, the flexible component 902 includes a surface treatment that acts as the wear surface 904. For example, the flexible component 902 may be aluminum, and one or more surfaces of the aluminum may be anodized to form a wear surface 904.

In certain embodiments, the flexible deck 802 is connected to the suspension connector 804. The flexible deck 802 may be connected to the suspension connector 804 using one or more deck fasteners 906. In some embodiments, the one or more deck fasteners 906 may interact with one or more deck fastener plates 908 to secure the flexible component 902 to the suspension connector 804. In some embodiments, the one or more deck fasteners 906 may interact with one or more deck fastener plates 908 to secure the wear surface 904 to the suspension connector 804.

The suspension connector 804 may include one or more suspension fasteners 910. The one or more suspension fasteners 910 may secure the suspension connector 804 to the frame 801.

Figure 10:
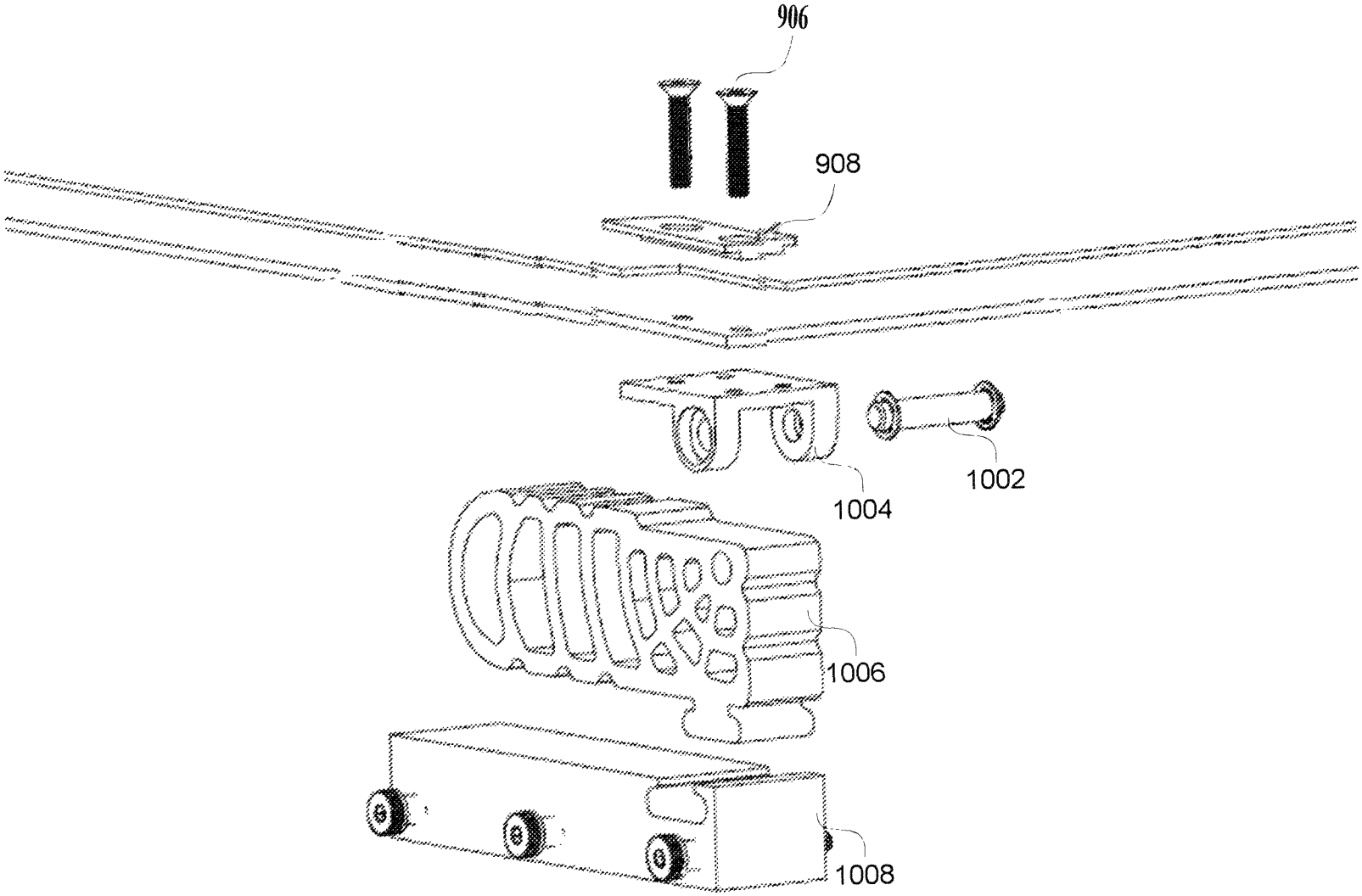
FIG. 10 depicts an exploded perspective view of one embodiment of the suspension connector of FIG. 8.

FIG. 10 depicts an exploded perspective view of one embodiment of the suspension connector 804 of FIG. 8. The suspension connector 804 includes a suspension pivot 1002, a suspension pivot bracket 1004, a suspension element 1006, and a suspension mounting block 1008. The suspension connector 804 connects the flexible deck 802 to the frame 801 and contributes to management of flexion of the flexible deck 802.

The suspension pivot 1002, in one embodiment, allows rotation of a connected component around an axis of the suspension pivot 1002 and restricts rotation around other axes or translation of the connected components. In the illustrated embodiment, the suspension pivot 1002 allows rotation of the suspension pivot bracket 1004 relative to the suspension element 1006.

In some embodiments, the suspension pivot bracket 1004 is connected to the flexible deck 802 by one or more deck fasteners 906. In some embodiments, the deck fasteners 906 cooperate with a deck fastener plate 908 to secure one or more elements of the flexible deck 802 to the suspension pivot bracket 1004. An interaction between the suspension pivot bracket 1004 and the suspension pivot 1002 may allow at least a portion of the attached flexible deck 802 to rotate around the suspension pivot 1002 in response to a load applied to the flexible deck 802, such as that applied by a user striding on the treadmill 800.

The suspension pivot 1002 may be rotatably connected to the suspension bracket 1004 and the suspension element 1006. The suspension element 1006 may be configured to deform under an applied force. In some embodiments, the suspension element 1006 allows for one or more of rotation and translation of the flexible deck 802 relative to other components of the treadmill 800. In one embodiment, the suspension element 1006 allows a portion of the flexible deck 802 near the suspension pivot bracket 1004 to rotate around the suspension pivot 1002 under a load applied by a user striding on the treadmill 800.

The suspension element 1006 may include any material capable of performing the functions of the suspension element 1006. For example, the suspension element 1006 may include a polymer material. In one example, the suspension element 1006 includes polyurethane.

In one embodiment, suspension mounting block 1008 is attached to the suspension element 1006 and the frame 801. The suspension mounting block 1008 may be attached to other components using fasteners, formed keyways, or a combination of these. In one embodiment, the suspension mounting block 1008 is a relatively stiff and strong material, such as steel or aluminum.

Figure 11:
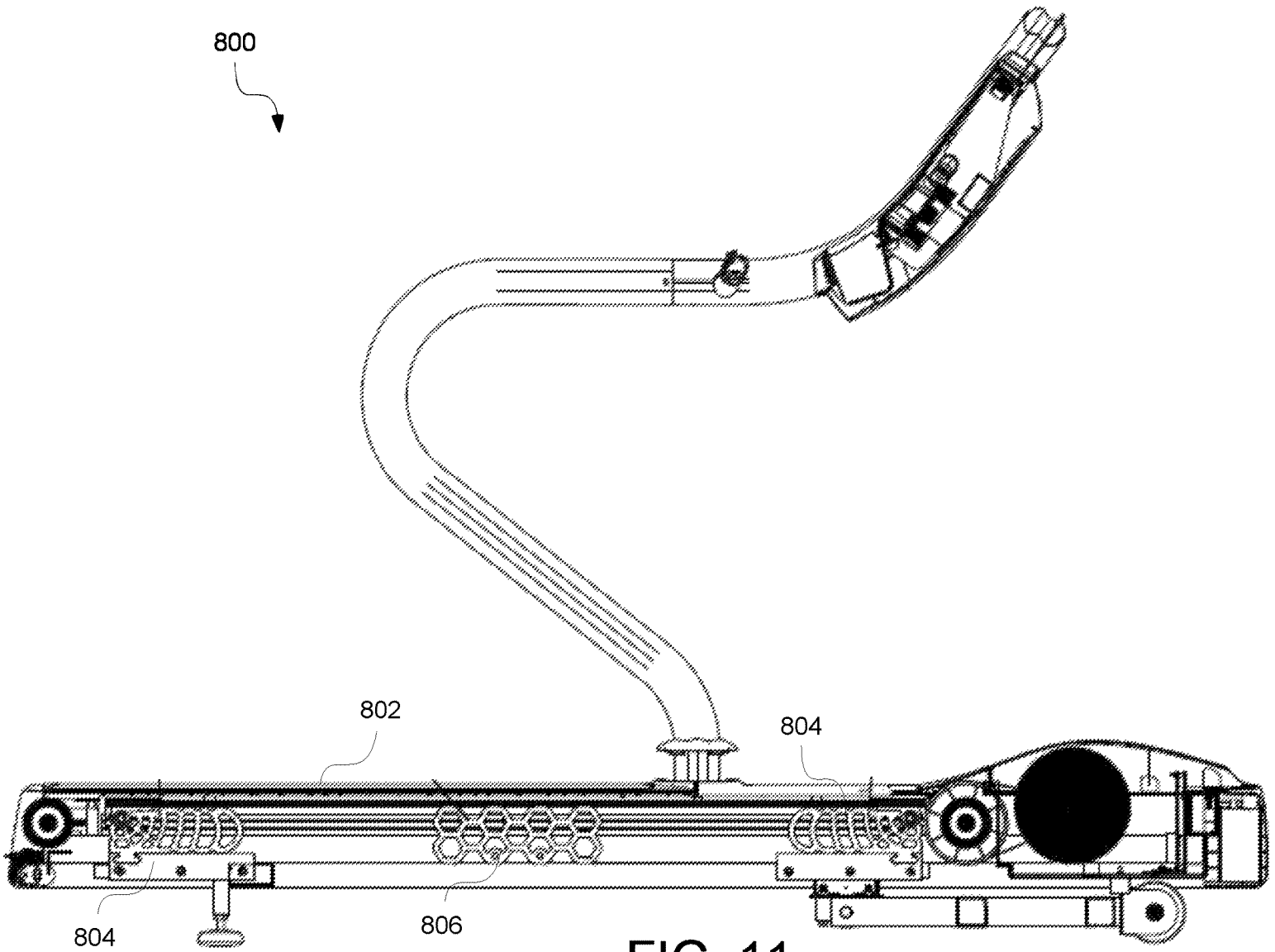
FIG. 11 depicts a side cross-sectional view of one embodiment of the treadmill of FIG. 8.

FIG. 11 depicts a side cross-sectional view of one embodiment of the treadmill 800 of FIG. 8. The treadmill 800 includes a flexible deck 802, one or more suspension connectors 804, and one or more intermediate supports 806. The flexible deck 802, the one or more suspension connectors 804, and the one or more intermediate supports 806 may be similar to like-numbered components described above. The treadmill 800 provides a striding surface with a managed flex response.

In one embodiment, the treadmill 800 includes four suspension connectors 804. The flexible deck 802 may be substantially rectangular and a suspension connector 804 may be disposed at or near each corner of the rectangular flexible deck 802. The suspension connectors 804 may connect the flexible deck 802 to other components of the treadmill 800. In some embodiments, the suspension connectors 804 deform under a force applied by a user striding on the treadmill 800 to manage a flex response of the flexible deck 802.

The treadmill 800, in some embodiments, includes two intermediate supports 806. The flexible deck 802 may be substantially rectangular and an intermediate support 806 may be disposed between two suspension connectors 804 at or near a side of the rectangular flexible deck 802. In some embodiments, the treadmill 800 includes two intermediate supports 806, one disposed under a right side of the flexible deck 802 and the other disposed under a left side of the flexible deck 802. The intermediate supports 806 may support the flexible deck 802 relative to other components of the treadmill 800. In some embodiments, the intermediate supports 806 deform under a force applied by a user striding on the treadmill 800 to manage a flex response of the flexible deck 802. In one embodiment, the stiffness of the intermediate supports 806 is adjustable.

Figure 12A:
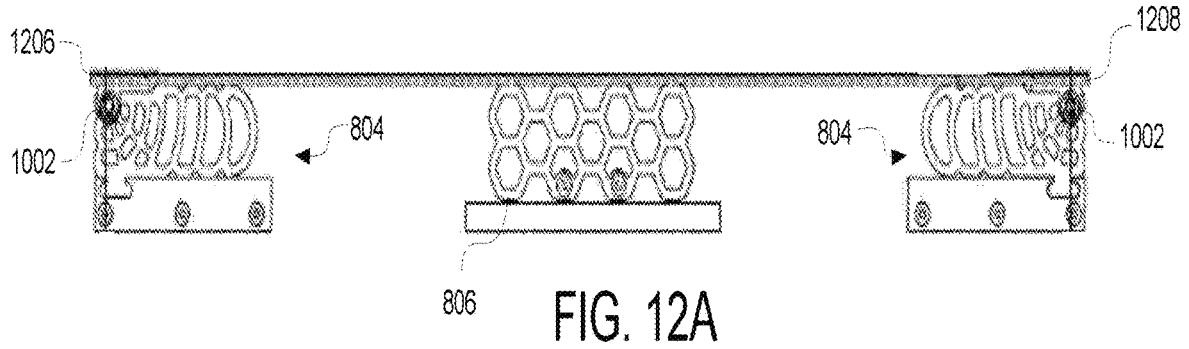
FIG. 12A-12C depict side views of one embodiment of the flexible deck of FIG. 8 under no applied force, a moderate applied force, and a high applied force, respectively.
Figure 12B:
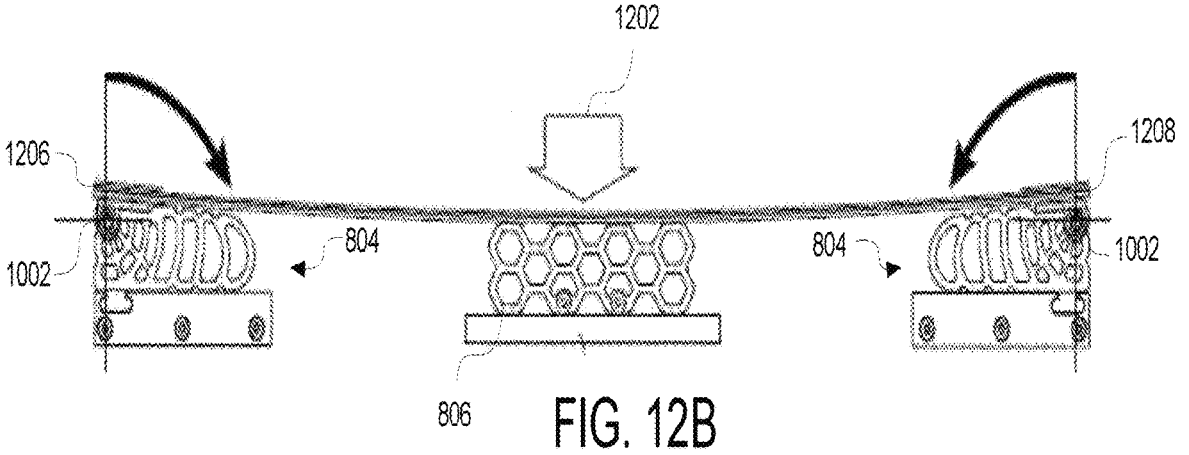
Figure 12C:
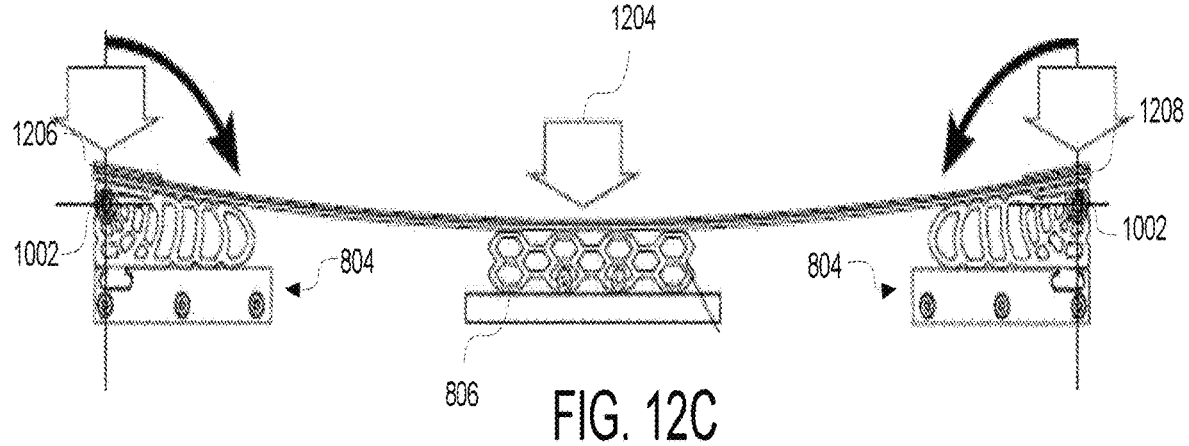

FIG. 12A-12C depict side views of one embodiment of the flexible deck 802 of FIG. 8 under no applied force, a moderate applied force 1202, and a high applied force 1204, respectively. The flexible deck 802 is connected to the treadmill 800 via a plurality of suspension connectors 804. The flexible deck 802 is configured to flex under an applied force.

In one embodiment, the flexible deck 802 is substantially rectangular and a suspension connector 804 is disposed at each of a first end 1206 and a second end 1208 of the flexible deck 802. The suspension connectors 804 are configured to rotate around a suspension pivot 1002 in response to an applied load. In FIG. 12B, a moderate applied load 1202, such as that caused by a relatively low-weight user striding on the treadmill 800, causes moderate flexion of the flexible deck 802. At or near the first end 1206, the flexible deck 802 pivots around the suspension pivot 1002 in response to the moderate applied force 1202. At or near the second end 1208, the flexible deck 802 pivots in an opposite direction around a suspension pivot 1002 in response to the moderate applied force 1202. In response to a relatively high applied force 1204, flexion and pivoting of the deck is relatively higher than that caused in response to the moderate applied force 1202.

The intermediate support 806, in some embodiments, supports the flexible deck 802 and resists flexion of the flexible deck 802. In response to the moderate applied force 1202, the intermediate support 806 deforms and applies a reaction force to counter the intermediate force 1202. In response to a relatively high applied force 1204, deformation of the intermediate support 806 and the resulting reaction force are relatively higher.

Figure 13:
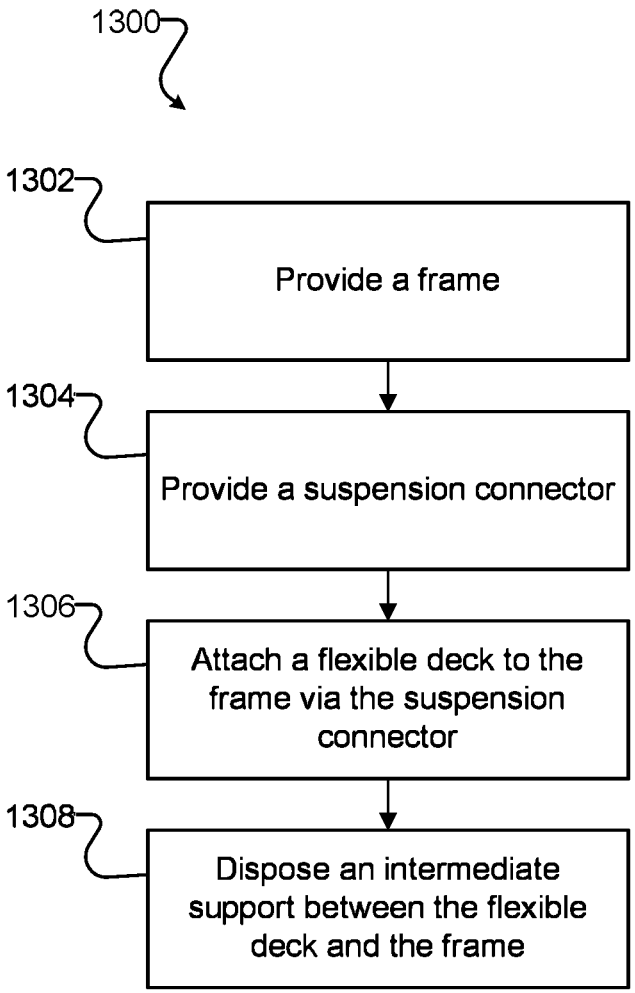
FIG. 13 is a flowchart diagram depicting one embodiment of a method for manufacturing treadmill with a flexible deck.

FIG. 13 is a flowchart diagram depicting one embodiment of a method 1300 for manufacturing treadmill 100 with a flexible deck 104. The method 1300 is in certain embodiments a method of use or manufacture of the system and apparatus of FIGS. 1-12, and will be discussed with reference to those figures. Nevertheless, the method 1300 may also be conducted independently thereof and is not intended to be limited specifically to the specific embodiments discussed above with respect to those figures.

As shown in FIG. 13, a frame 202 is provided, at block 1302. The frame may provide connection points and support for other elements of the treadmill 100. In certain embodiments, a suspension connector 204 is provided, at block 1304. The suspension connector 204 may include components configured to deform under an applied load.

A flexible deck 104 is attached, at block 1306, to the frame 102 via the suspension connector 204 in some embodiments. The flexible deck 104 may be attached to the suspension connector 204 and the suspension connector 204 may be attached to the frame 102. The suspension connector 204 may allow and manage flexion of the flexible deck 104 in response to loads caused by users of the treadmill 100 striding on the treadmill 100.

In some embodiments, an intermediate support 206 is disposed, at block 1308, between the flexible deck 104 and the frame 102. The intermediate support 206 may be connected to one or both of the flexible deck 104 and the frame 102. The intermediate support 206 supports the flexible deck 102. In some embodiments, the intermediate support 206 deforms in response to a force applied by the flexible deck 104 as the flexible deck 104 flexes. The intermediate support 206 may manage flexion of the flexible deck 104.

The components described herein may include any materials capable of performing the functions described. Said materials may include, but are not limited to, steel, stainless steel, titanium, tool steel, aluminum, polymers, and composite materials. The materials may also include alloys of any of the above materials. The materials may undergo any known treatment process to enhance one or more characteristics, including but not limited to heat treatment, hardening, forging, annealing, and anodizing. Materials may be formed or adapted to act as any described components using any known process, including but not limited to casting, extruding, injection molding, machining, milling, forming, stamping, pressing, drawing, spinning, deposition, winding, molding, and compression molding.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by any claims appended hereto and their equivalents.

What is claimed is:

1. A treadmill comprising:

a frame;

a plurality of suspension connectors connected to the frame;

a flexible deck connected to the plurality of suspension connectors;

a belt disposed on the flexible deck; and an intermediate support disposed between the frame and the flexible deck and between the plurality of suspension connectors, wherein the plurality of suspension connectors provide at least one of rotation or translation of at least a portion of the flexible deck relative to the frame.

2. The treadmill of claim 1, further comprising a wear surface that reduces wear of the flexible deck.

3. The treadmill of claim 2, wherein the wear surface is disposed between the flexible deck and the belt.

4. The treadmill of claim 3, wherein an end of the flexible deck is supported by at least one suspension connector of the plurality of suspension connectors and connected to the at least one suspension connector via one or more deck fasteners.

5. The treadmill of claim 4, wherein the one or more deck fasteners interact with one or more deck fastener plates to connect the flexible deck to the at least one suspension connector.

6. The treadmill of claim 5, wherein at least one suspension connector of the plurality of suspension connectors comprises a suspension pivot, the suspension pivot connected to the frame, wherein the portion the flexible deck pivots around the suspension pivot in response to an applied force on the flexible deck.

7. The treadmill of claim 1, wherein a stiffness of the intermediate support is adjustable.

8. The treadmill of claim 7, wherein the stiffness of the intermediate support automatically adjusts in response to a weight of a user.

9. The treadmill of claim 8, further comprising a pump to pump fluid into or out of the intermediate support to adjust the stiffness of the intermediate support.

10. The treadmill of claim 1, wherein a position of the intermediate support is adjustable.

11. The treadmill of claim 10, wherein the intermediate support automatically moves in response to a weight of a user.

12. The treadmill of claim 11, further comprising an electromagnetic actuator to adjust the position of the intermediate support.

13. The treadmill of claim 1, wherein the flexible deck comprises a heat transfer surface configured to transfer heat from the belt.

14. The treadmill of claim 1, wherein the intermediate support is disposed on one of two opposing sides of the frame.

15. A method of manufacturing a treadmill, the method comprising:

providing a frame;

connecting a plurality of suspension connectors to the frame;

connecting a flexible deck to the plurality of suspension connectors;

disposing a belt on the flexible deck; and disposing an intermediate support between the frame and the flexible deck and between the plurality of suspension connectors, wherein the plurality of suspension connectors provide at least one of rotation or translation of at least a portion of the flexible deck relative to the frame.

16. The method of claim 15, further comprising providing a wear surface that reduces wear of the flexible deck.

17. The method of claim 16, further comprising disposing the wear surface between the flexible deck and the belt.

18. The method of claim 17, further comprising:

supporting an end of the flexible deck by at least one suspension connector of the plurality of suspension connectors; and connecting the flexible deck to the at least one suspension connector via one or more deck fasteners.

19. The method of claim 18, further comprising interacting the one or more deck fasteners with one or more deck fastener plates to connect the flexible deck to the suspension connector.

20. The method of claim 15, wherein the flexible deck comprises a heat transfer surface configured to transfer heat from the belt.

* * * * *